US005261669A

United States Patent [19]

Kochevar

[11] Patent Number: 5,261,669

[45] Date of Patent: Nov. 16, 1993

[54] WEIGHTED GOLF CLUB AND METHOD OF MAKING THE SAME

[76] Inventor: Rudolph J. Kochevar, P.O. Box 3082, Arcadia, Calif. 91066

[21] Appl. No.: 27,410

[22] Filed: Mar. 8, 1993

[51] Int. Cl.[5] ..... A63B 53/02; A63B 53/04

[52] U.S. Cl. ..... 273/169; 273/167 F; 273/80.8; 273/80.5

[58] Field of Search ..... 273/80 R, 80 A, 80 B, 273/80 C, 80 D, 80.1, 80.2, 80.3, 80.4, 80.5, 80.6, 80.7, 80.8, 80.9, 77 R, 167 K, 169, 167 F, 193 R, 194 R, 194 B, 171, 173, 170, 81 R

[56] References Cited

U.S. PATENT DOCUMENTS

| | | | |
|---|---|---|---|
| 1,540,559 | 6/1925 | Murphy | 273/80.3 |
| 1,564,208 | 12/1925 | Connolly . | |
| 3,064,980 | 11/1962 | Steiner | 273/171 |
| 3,313,541 | 4/1967 | Benkoczy et al. | 273/80 B |
| 3,355,226 | 11/1967 | Portz | 273/80.5 X |
| 3,410,558 | 11/1968 | Reuter | 273/80.2 |
| 3,572,709 | 10/1968 | Risher | 273/80.2 |
| 3,625,513 | 12/1971 | Ballmer | 273/80.5 |
| 3,998,458 | 12/1976 | Inoue et al. | 273/80 R |
| 4,023,801 | 5/1977 | VanAuken | 273/80 B |
| 4,063,737 | 12/1977 | Tom et al. | 273/80.5 X |
| 4,220,336 | 9/1980 | Kochevar | 273/80.8 |
| 4,319,750 | 3/1982 | Roy | 273/80 B |
| 4,452,456 | 6/1984 | Kochevar | 273/80.8 X |
| 4,496,153 | 1/1985 | Kochevar | 273/80.8 |
| 4,715,606 | 12/1987 | Varley | 273/170 X |
| 4,757,997 | 7/1988 | Roy | 273/80 B |
| 4,854,583 | 8/1989 | Kobayashi | 273/80.2 X |
| 5,071,687 | 12/1991 | Shigetoh | 273/80 R X |
| 5,088,735 | 2/1992 | Shigetoh | 273/80 B |
| 5,093,162 | 3/1992 | Fenton et al. | 273/80 B X |
| 5,181,720 | 1/1993 | Stites et al. | 273/80.8 X |
| 5,205,552 | 4/1993 | Green | 273/80.2 X |

*Primary Examiner*—V. Millin
*Assistant Examiner*—Sebastiano Passaniti
*Attorney, Agent, or Firm*—Gordon L. Peterson

[57] ABSTRACT

A golf club comprising a golf club head having a passage terminating in the head and an elongated shaft having a generally axially extending bore and counterbore. The counterbore opens at one end of the shaft. An end portion of the shaft is received in the passage of the head and a weight is retained in the counterbore.

16 Claims, 1 Drawing Sheet

WEIGHTED GOLF CLUB AND METHOD OF MAKING THE SAME

BACKGROUND OF THE INVENTION

In order to provide the desired characteristics to a set of golf clubs, it is common practice to appropriately weight each of the clubs using weights of predetermined magnitudes. A variety of techniques can be used to accomplish this including the technique shown and described in my U.S. Pat. No. 4,220,336.

A typical golf club includes a golf club head having a passage terminating in the head and an elongated shaft having a generally axially extending bore opening at one end of the shaft. An end portion of the shaft is received in the passage of the head and is affixed to the head. It is common practice to retain the weight in the end portion of the shaft which is received within the golf club head.

In order to impart the desired weight characteristic to the golf club, the weight, which is commonly referred to as a swing weight, should be located at and very near the bottom of the bore of the shaft. The weighting technique described above is adequate when the diameter of the bore of the shaft is sufficiently large to permit a weight of the desired size to be located at and near the bottom of the bore of the shaft. However, for golf clubs which have a relatively small diameter bore in the shaft, it may not be possible to locate a weight of the desired size at the desired location.

Shafts which are more likely to have a bore of too small a diameter are shafts that are formed by winding of an elongated member such as sheets or filaments of, or including, fiberglass, graphite and the like. The small diameter is the result of needing to impart the shaft with various characteristics such as strength and flexibility. The wound member is commonly held in place by a suitable matrix or binder, which may be of a polymeric material. The specific techniques for forming shafts of this type may vary, but they typically include the wrapping or spinning of a member on a mandrel.

SUMMARY OF THE INVENTION

This invention provides a golf club and method which enable the proper weighting of golf clubs regardless of the cross sectional area of the bore through the shaft. This is accomplished by providing an elongated shaft which has a generally axially extending counterbore which opens at the end of the shaft which is received in the golf club head. The weight is retained in the counterbore. Because the counterbore has a larger cross sectional area than the bore, a larger weight can be retained at the desired location, i.e. far down in the shaft at or near the end of the shaft in the golf club head.

The formation of the counterbore in the end portion of the shaft weakens the shaft at that location. However, by adhering the weight to the portion of the shaft which has the counterbore, the weight can be used to strengthen and reinforce the shaft at this location. In order to accomplish this strengthening function, the weight should possess strength and may be, for example, of a metal or metal alloy such as a lead alloy, a polymeric material such as ABS or a suitable ceramic. Alternatively or in additional thereto, the portion of the shaft having the counterbore may be reinforced with sheets or fibers of a metal such as boron or a material such as Kevlar.

To aid in supporting the weight against movement in the counterbore, the weight preferably extends for substantially the full length of the counterbore. Retention of the weight is enhanced by having the weight bear against a shoulder between the bore and the counterbore. Preferably a portion of the weight is outside the counterbore to form a supporting plug and the end of the shaft bears against the supporting plug to further assist in retaining the weight against movement. The weight preferably has a passage extending through the weight with the passage communicating with the bore to allow for venting as the shaft is inserted down into the hosel during manufacture. Although the features of this invention are applicable regardless of the manner in which the shaft is made and regardless of the nature of the shaft, it is particularly adapted for shafts which include a wound member as described above.

Most, but not all, golf clubs include swing weights. The counterbore shaft of this invention can be used with a swing weight or with a dummy weight. A swing weight is weight of an accurately predetermined magnitude that is used to impart a desired characteristic to the golf club. On the other hand, a dummy weight is a weight employed in the counterbore only for the purpose of strengthening the portion of the shaft having the counterbore. The term "weight" as used herein is intended to include both swing weights and dummy weights.

Swing weights and dummy weights are usually distinguishable in other ways. For example, a swing weight is typically constructed of, or includes, a metal such as a lead alloy. A dummy weight is preferably constructed of an inexpensive polymeric material such as ABS. Swing weights are normally heavier than dummy weights and range from one gram upwardly whereas dummy weights are ordinarily less than 0.75 grams and are typically in the range of 0.2 to 0.4 grams.

The counterbore can be formed in different ways. For example, a shaft may be formed with an elongated bore and then the shaft can be drilled to form the counterbore. A more preferred technique is to wind at least one member on a mandrel having an elongated section and a radially enlarged section to form the elongated shaft. With this technique, the elongated section and the enlarged section of the mandrel form the bore and the counterbore, respectively. This technique is preferred because it forms both the bore and counterbore in a one step process and eliminates any likelihood of damage to the shaft from the heat from drilling or any error in the drilling operation.

The invention, together with additional features and advantages thereof may best be understood by reference to the following description taken in connection with the accompanying illustrative drawing.

DESCRIPTION OF THE PREFERRED EMBODIMENT

Figure 1:
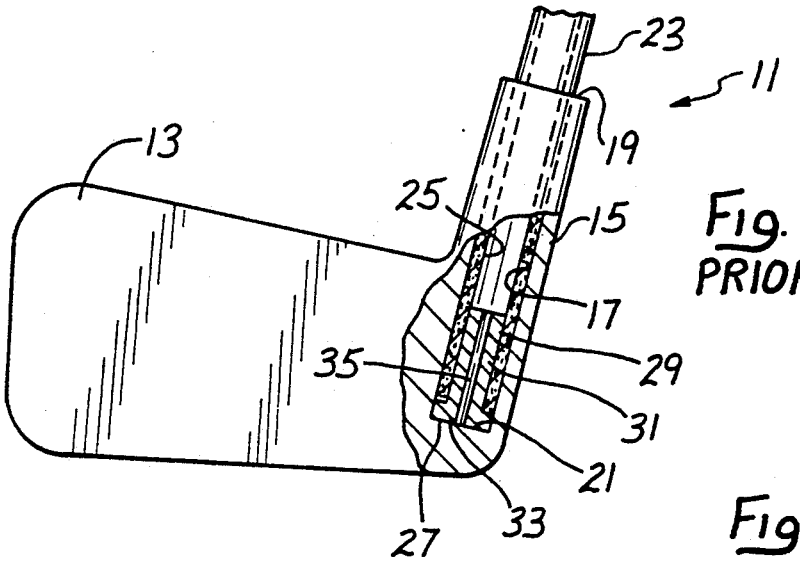
Fig. 1 PRIOR ART
FIG. 1 is a fragmentary front elevational view partially in section of a golf club which has been weighted in accordance with a prior art technique.

FIG. 1 shows a prior art golf club 11 which may be a wood or an iron and which includes a golf club head 13 having an integral tubular section or hosel 15 extending upwardly. The tubular section 15 has a passage 17 which opens at an upper end 19 of the tubular section 15 and which terminates in an end wall 21 in the golf club head 13.

The golf club 11 also includes an elongated tubular shaft 23 having a generally axially extending, large diameter bore 25 extending completely through the shaft and opening at a bottom end 27 of the shaft. The shaft 23 is received in the passage 17 of the head 13 and is attached to the head by a suitable adhesive (not shown).

The golf club 11 includes a weight 29 which may be, for example, a solid metal weight or a weight capsule of the type described in my U.S. Pat. No. 4,220,336. The weight 29 includes a rod-like section 31 in the bore 25 and a supporting plug 33 outside of the bore 25 between the bottom end 27 and the end wall 21. The weight 29 has an axial passage 35 extending through it which communicates with the bore 25. The weight is attached to the shaft 23 and the head 13 by a suitable adhesive (not shown).

The prior art construction of FIG. 1 is satisfactory for weighting of the golf club 13 provided that the bore 25 is of large enough diameter to accommodate a sufficient quantity of the weight 29 at a location at and near the bottom of the bore 25. However, if the shaft 23 has a bore 25 of relatively small diameter, the rod-like section 31 of the weight would need to be too long in order to provide adequate weight for the club and this would elevate the weight too high up in the bore.

Figure 2:
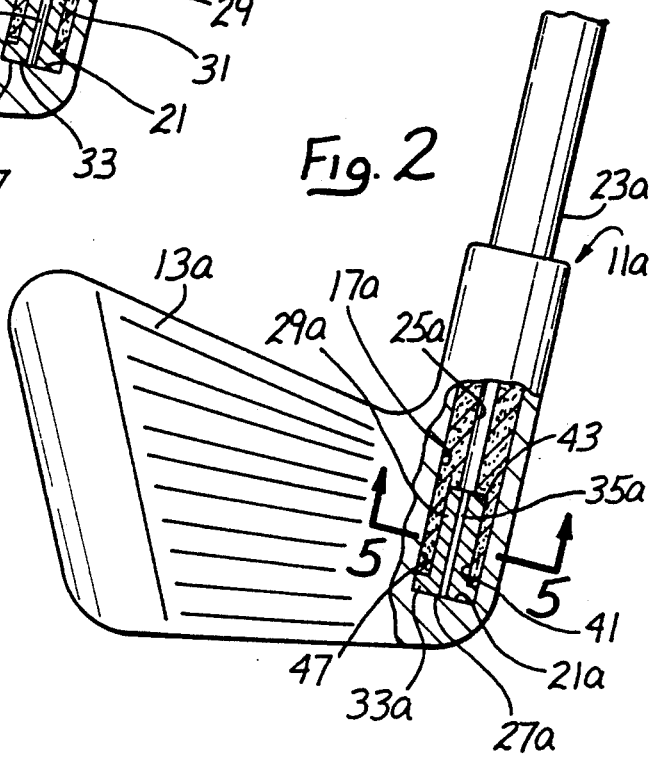
FIG. 2 is a view similar to FIG. 1 illustrating one way to weight a golf club in accordance with the present invention.
Figure 5:
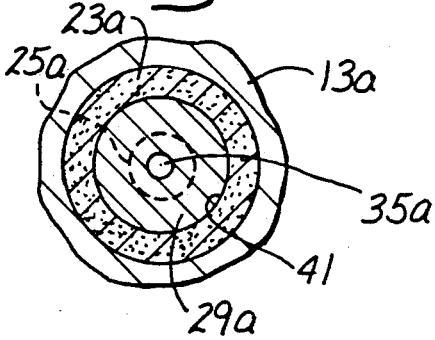
FIG. 5, is an enlarged fragmentary sectional view taken generally along line 5—5 of FIG. 2.

FIG. 2 shows a golf club **11*a* in which the bore 25*a* is relatively small and may be, for example, about 0.100 inch in diameter. Although the diameter of the bore 25*a* may be reduced for any reason, in this embodiment, it is the result of constructing the shaft 23 in a winding process. More specifically, the shaft 23*a*** is constructed of composite materials which includes graphite and a binder or an adhesive.

Except for the shaft **23*a* and except as shown or described herein, the golf club 11*a* may be identical to the golf club 11. Portions of the golf club 11*a* corresponding to portions of the golf club 11** are designated by corresponding reference numerals followed by the letter "a".

The shaft **23*a* has a bore 25*a* and a counterbore 41 of cylindrical configuration coaxial with the bore 25*a*. The shaft 23*a* has an annular shoulder 43 lying in radial plane between the bore 25*a* and the counterbore 41. If desired, the shoulder 43 may be radiused or tapered to reduce the likelihood of fracture. The size of the counterbore 41 may be different for woods and irons and as an example, the counterbore 41** may have a diameter of about 0.225 inch and a length of about 1.2 inch.

The weight **29*a* preferably extends for the full length of the counterbore 41 and bears against the shoulder 43 to aid in capturing the weight and securely holding it against movement relative to the shaft 23*a*. The supporting plug 33*a* is also securely captured between the bottom end 27*a* of the shaft 23 and the end wall 21*a*. In addition, the weight 41 is attached to the head 13*a* and the shaft 23*a*** with a suitable adhesive, such as an epoxy (not shown).

Because the diameter of the counterbore 41 is larger than the diameter of the bore **25*a*, a larger quantity of the weight 29*a* can be located at the desired location, i.e. farther down in the shaft 23*a* than would be possible if the counterbore 41** were not provided.

The formation of a counterbore 41 provides the shaft **23*a* with a relatively thin wall section 47 along the counterbore. Another function of the weight 29*a* is to reinforce and strengthen the shaft 23*a* along the wall section 47. When the weight 29*a* is a swing weight, it is typically constructed of metal and is adhered to the wall section 47 to thereby strengthen and reinforce the wall section. Alternatively, if the weight 29*a* is a dummy weight, it may be constructed of a polymeric material, such as ABS and also be adhered to the wall section 47. In either event, the weight 29*a* possesses the necessary structural properties to reinforce and strengthen the wall section 47. In addition, the wall section 47** may include reinforcing material such as boron fibers.

The weight of the weight 41 can be varied in different ways as by increasing or decreasing the size of the passage **35*a* and/or by using different materials for the weight. The length of the weight 29*a* can also be reduced, and if desired, any space between the upper end of the weight and the shoulder 43** can be filled with a dummy weight of lighter material, such as an adhesive.

Figure 3:
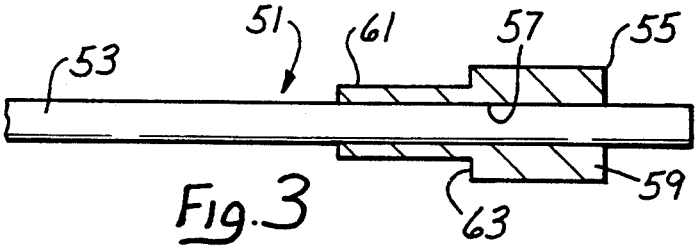
FIG. 3 is a fragmentary elevational view partially in section of a mandrel which can be used in making the shaft for the golf club of FIG. 2.
Figure 4:
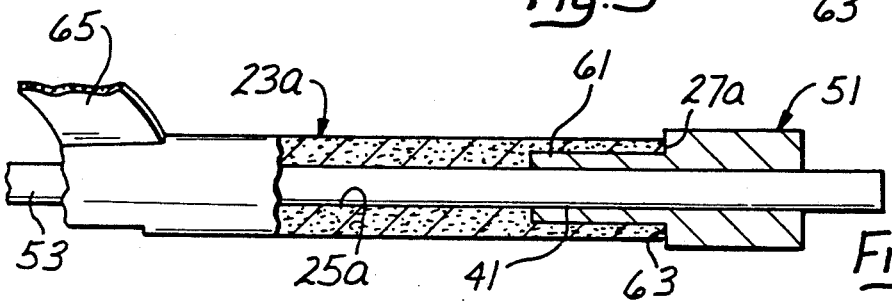
FIG. 4 is a somewhat schematic view similar to FIG. 2 illustrating the shaft of the golf club being formed on the mandrel.

FIGS. 3 and 4 illustrate a preferred method of making the shaft **23*a*. FIG. 3 shows a mandrel 51 having an elongated rod section 53 and a tubular enlarged section 55 having an axial passage 57 extending completely through it and receiving the rod section 53. The enlarged section 55 includes a cylindrical head 59 and a cylindrical sleeve 61 of smaller diameter than the head 59. The enlarge section 55 has an annular shoulder 63 between the head 59 and the sleeve 61**.

In use, at least one member 65 which may be a sheet or filament of any known composite golf shaft material is wound on the mandrel 51 in a known manner. Multiple sheets and/or filaments of various materials may be used in accordance with known practice. In fact, if the mandrel 51 did not include the enlarged section 55 this winding technique and the ultimately formed shaft would be in accordance with known practice. However, by carrying out the winding process on the mandrel as shown in FIG. 4, the sleeve 61 forms the counterbore 41 during the winding process. The winding of the member 65 terminates at the shoulder 63 to form the bottom end **27*a* of the shaft 23*a*. The rod section 53 forms the bore 25*a*** in a conventional manner.

The member **65*a* may include a curable binder or a curable binder may be appropriately added such that upon completion of the winding operation and curing, the shaft 23*a* is formed. Following this, the weight 41 may be adhered to the shaft 23*a* as shown in FIG. 2 and the weighted shaft then inserted into the passage 17*a* of the golf club head 13*a* and adhered to the head. Air in the bottom of the passage 17*a* is vented out through the passage 35*a* and the bore 25*a* through the upper end (not shown) of the shaft 23*a* as the shaft 23*a* is inserted down into the passage 17*a***.

An alternative and less preferred method of making the shaft **23*a* is to form the shaft in a conventional manner utilizing only the rod section 53 of the mandrel 51 so that the shaft is formed with the bore 25*a* and without the counterbore 41. The end of the shaft 23*a* is then drilled to form the counterbore 41**.

Although exemplary embodiments of the invention have been shown and described, many changes, modifications and substitutions may be made by one having ordinary skill in the art without necessarily departing from the spirit and scope of this invention.

I claim:

1. A golf club comprising:

a golf club head having a passage terminating in said head;

an elongated shaft having a generally axially extending bore and a counterbore, said counterbore opening at one end of said shaft;

an end portion of said shaft including said end of said shaft being received in the passage of said head and being affixed to said head; and a weight retained in said counterbore.

2. A golf club as defined in claim 1 wherein the weight extends for substantially the full length of the counterbore.

3. A golf club as defined in claim 1 wherein said shaft has a shoulder between the bore and the counterbore and the weight bears against the shoulder.

4. A golf club as defined in claim 1 wherein the weight has a passage extending through the weight and said passage communicates with said bore.

5. A golf club as defined in claim 1 wherein a portion of said weight is outside the counterbore to form a supporting plug and said end of the shaft bears against the supporting plug.

6. A golf club as defined in claim 5 wherein said shaft has a shoulder between the bore and the counterbore, the weight bears against the shoulder and extends for substantially the full length of the counterbore, the weight has a passage extending through the weight and said passage communicates with said bore.

7. A golf club as defined in claim I wherein the weight extends for substantially the full length of the counterbore, said shaft has a shoulder between the bore and the counterbore and the weight bears against the shoulder, the weight has a passage extending through the weight, said passage communicates with said bore and including an adhesive for adhering the weight in the counterbore.

8. A golf club as defined in claim I wherein said shaft includes a wound member and an adhesive adheres the weight to the portion of the shaft which has the counterbore.

9. A golf club as defined in claim 8 wherein the weight includes metal and is selected to weight the golf club the desired amount.

10. A golf club as defined in claim 8 wherein the weight includes polymeric material and weighs no more than about 0.75 gram.

11. A golf club as defined in claim 8 wherein the weight extends for substantially the full length of the counterbore.

12. A method of making a golf club comprising:

forming an elongated shaft having a generally axially extending bore and counterbore with the counterbore opening at one end of the shaft;

placing a weight in the counterbore;

affixing the shaft to a golf club head adjacent said one end of the shaft; and retaining the weight against significant movement in the counterbore relative to the shaft.

13. A method as defined in claim 12 wherein said step of forming includes winding at least one member on a mandrel having an elongated section and a radially enlarged section to form the elongated shaft with the elongated section and the enlarged section forming the bore and counterbore, respectively.

14. A method as defined in claim 13 wherein the step of retaining includes adhering the weight to the portion of the shaft which has the counterbore.

15. A method as defined in claim 12 wherein said step of forming includes forming the elongated shaft having the bore and drilling the shaft to form the counterbore.

16. A method as defined in claim 15 wherein said step of forming includes winding at least one member on a mandrel to form the elongated shaft and the bore.

* * * * *